US012538985B1

(12) United States Patent
Mager

(10) Patent No.: US 12,538,985 B1
(45) **Date of Patent: *Feb. 3, 2026**

(54) SWAYING BED WITH LONGITUDINAL STABILIZERS

(71) Applicant: Donald V. Mager, Mendota Heights, MN (US)

(72) Inventor: Donald V. Mager, Mendota Heights, MN (US)

( * ) Notice: Subject to any disclaimer, the term of this patent is extended or adjusted under 35 U.S.C. 154(b) by 520 days.

This patent is subject to a terminal disclaimer.

(21) Appl. No.: 18/142,818

(22) Filed: May 3, 2023

Related U.S. Application Data

(60) Provisional application No. 63/473,376, filed on May 25, 2022.

(51) Int. Cl.
*A47C 19/02* (2006.01)
*A47C 21/00* (2006.01)

(52) U.S. Cl.
CPC ..... *A47C 21/006* (2013.01)

(58) Field of Classification Search
CPC .... A47C 19/021; A47C 21/006; A47C 3/0255
USPC ..... 5/131
See application file for complete search history.

(56) References Cited

U.S. PATENT DOCUMENTS 50,920 A * 11/1865 Dorman ..... A47D 9/02 5/120
138,582 A * 5/1873 Raub ..... A47C 19/022 5/212
409,545 A * 8/1889 Zeigler ..... A47C 3/0255 297/363
577,419 A * 2/1897 Carver et al. ..... A47C 3/0255 5/604
596,858 A * 1/1898 Dent, Jr. ..... A47C 19/021 5/306
1,372,219 A * 3/1921 Dieckmann ..... A47C 17/84 5/127
1,444,726 A * 2/1923 Broyles ..... A61G 7/00 5/103
1,795,202 A * 3/1931 Dillingham ..... A47C 3/0255 297/282
1,953,752 A * 4/1934 Erieson ..... A47C 3/0255 5/124

(Continued)

*Primary Examiner* — Justin C Mikowski
*Assistant Examiner* — Luke Hall
(74) *Attorney, Agent, or Firm* — Johnson and Phung; Thomas N. Phung

(57) ABSTRACT

A swayable bedframe that includes a mattress-supporting rigid platform having platform corners, a rigid platform support frame having a plurality of frame legs with the frame legs joined by corresponding beams, a platform support member attached proximal to each of the platform corners, a set of suspension cable connecting each of the platform support members to proximal to a first end each of the frame legs to allow the rigid platform to sway from side-to-side, a set of longitudinal stabilizers preventing movement of the platform in a longitudinal fore and aft direction while allowing side-to-side movement of the platform, a drive unit providing reciprocating force between the rigid frame and the platform, and a set of sway limiters ensuring that the mattress-supporting platform does not exceed a predetermined amount of movement relative the rigid platform support frame.

18 Claims, 2 Drawing Sheets

(56) References Cited

U.S. PATENT DOCUMENTS 1,957,005 A * 5/1934 Thum ..... A47C 3/0255 5/124
2,044,862 A * 6/1936 Smith ..... A47C 3/0255 5/127
2,210,522 A * 8/1940 Berkoben ..... A47C 3/0255 248/324
2,212,723 A * 8/1940 Yerrick ..... B63H 16/02 5/103
3,447,170 A * 6/1969 Spitz ..... A47C 23/005 297/452.17
4,080,673 A * 3/1978 Weisler ..... A47C 21/006 5/108
4,704,750 A * 11/1987 Wheelock ..... A47C 21/006 5/120
4,759,088 A * 7/1988 Brown ..... A47C 27/00 5/411
4,838,609 A * 6/1989 Christensen ..... A47C 3/0255 297/277
4,958,391 A * 9/1990 Egeland ..... A47C 17/84 5/414
4,977,631 A * 12/1990 Bretz ..... B62D 33/0612 267/74
5,107,556 A * 4/1992 Haider ..... A47C 3/0255 248/370
5,701,616 A * 12/1997 Rosenquist ..... A47C 19/20 5/8
6,199,552 B1 * 3/2001 Crespo ..... A47C 21/006 600/38
6,348,005 B1 * 2/2002 Tseng ..... A61G 7/008 472/125
6,507,962 B2 * 1/2003 Thurston ..... A47C 17/84 5/10.1
6,829,791 B2 * 12/2004 Roepke ..... A47C 17/84 5/10.1
2004/0143901 A1 * 7/2004 Roepke ..... A47C 17/84 5/10.2
2007/0180613 A1 * 8/2007 Gardner ..... B60P 3/39 5/118
2010/0223722 A1 * 9/2010 Burnett ..... A47C 19/045 5/11
2016/0088952 A1 * 3/2016 Graham ..... A47C 19/021 5/307
2018/0279794 A1 * 10/2018 Chapman ..... A47C 21/006
2023/0031881 A1 * 2/2023 Mackay ..... A61G 7/00

* cited by examiner

SWAYING BED WITH LONGITUDINAL STABILIZERS

FIELD OF THE INVENTION

This invention relates generally to bed frames and, more specifically to a bed frame that includes longitudinal stabilizers to prevent movement of the bed platform in a longitudinal direction and yet allow effortless side-to-side movement to provide a smooth swaying motion with very low noise and minimal power consumption.

CROSS-REFERENCE TO RELATED APPLICATIONS

This application claims priority to currently pending U.S. Provisional Application Ser. No. 63/473,376; filed on May 25, 2022; titled SWAYING BED WITH LONGITUDINAL STABILIZERS.

STATEMENT REGARDING FEDERALLY SPONSORED RESEARCH OR DEVELOPMENT

None

REFERENCE TO A MICROFICHE APPENDIX

None

BACKGROUND OF THE INVENTION

Relaxation and quality sleep, which includes falling asleep quickly and then staying asleep during the whole night, is a vital bodily function and is just as important as regular exercise and a healthy diet. Poor sleep may result in negative effects on a person's hormones, exercise performance, and brain function and it oftentimes may lead to weight gain and increased disease risk. However, in our current fast-paced, stress-ridden culture, relaxation and quality sleep are often hard to come by.

Providing a gently swaying motion such as those offered by hammocks has traditionally been known to lead to greater relaxation and improved quality of sleep. The present invention is directed at improving people's sleep quality by providing a bedframe that allows for a smooth swaying motion which not only leads to relaxation and the user falling asleep quickly but also the user staying asleep for a long period of time.

SUMMARY OF THE INVENTION

Briefly, the present invention is a swayable bedframe that includes a mattress-supporting rigid platform having a first end, a distal second end, and at least four platform corners and a rigid platform support frame having at least four frame legs joined by corresponding beams with each frame leg including a first end and a second support surface engaging end. Attached proximal to a first platform corner is a first platform support member, attached proximal to a second platform corner is a second platform support member, attached proximal to a third platform corner is a third platform support member, and attached proximal to the fourth platform corner is a fourth platform support member. Connecting the first platform support member to proximal the first end of the first frame leg is a first rigid or semi-rigid suspension cable, connecting the second platform support member to proximal the first end of the second frame leg is a second rigid or semi-rigid suspension cable, connecting the third platform support member to proximal the first end of the third frame leg is a third rigid or semi-rigid suspension cable, and connecting the fourth platform support member to proximal the first end of the fourth frame leg is a fourth rigid or semi-rigid suspension cable with the rigid or semi-rigid suspension cables functioning to allow the rigid platform to sway from side-to-side.

The swayable bedframe includes a first longitudinal stabilizer having a first end connected to the platform support frame proximal to the first frame leg and a second end connected to the third platform support member and a second longitudinal stabilizer having a first end connected to the platform support frame proximal to the second frame leg and a second end connected to the fourth platform support member. The longitudinal stabilizers function to prevent movement of the platform in a longitudinal fore and aft direction while allowing side-to-side movement of the platform through a flexing connection to enable an angular motion.

The swayable bedframe also includes a drive unit attached to the platform support frame and connected to the rigid platform. The drive unit provides a sinusoidal motion between the rigid frame and the mattress-supporting platform, resulting in a smooth swaying motion while producing less than 40 decibels of noise. The swayable bedframe further includes a set of sway limiters attached to the rigid platform support frame to ensure that the mattress-supporting platform does not exceed a predetermined amount of movement relative to either side of the rigid platform support frame when the drive unit's linkage to the mattress-supporting platform is disconnected.

DESCRIPTION OF THE PREFERRED EMBODIMENT

Figure 1:
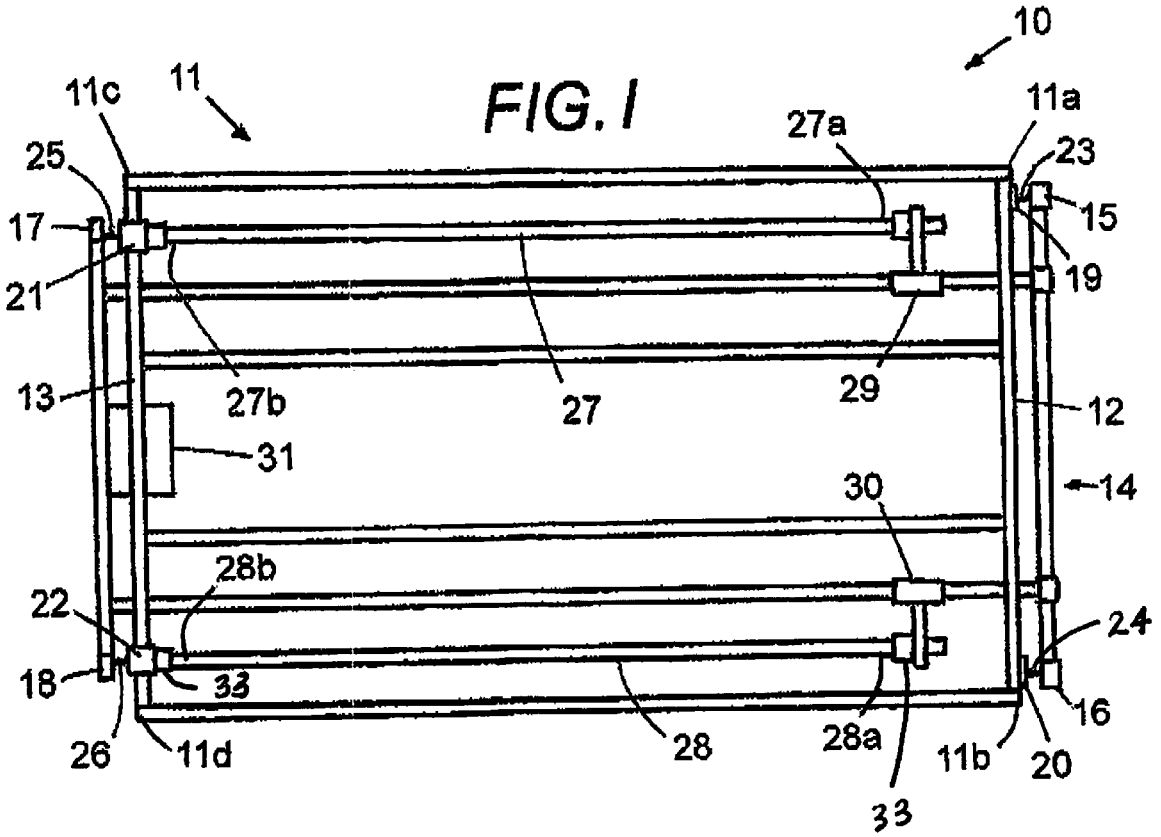
FIG. 1 is a top view of an embodiment of a swayable bedframe of the present invention.

The general purpose of the present invention, which will be described subsequently in greater detail, is to provide a bed frame that includes longitudinal stabilizers to prevent movement of the bed platform in a longitudinal direction and yet allow effortless side-to-side movement to provide a smooth swaying motion with very low noise and minimal power consumption.

There have thus been outlined the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the disclosing subject matter be regarded as including such equivalent constructions insofar as they do not depart from the spirit and scope of the present invention.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

In addition, the accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of any potential claims.

Figure 2:
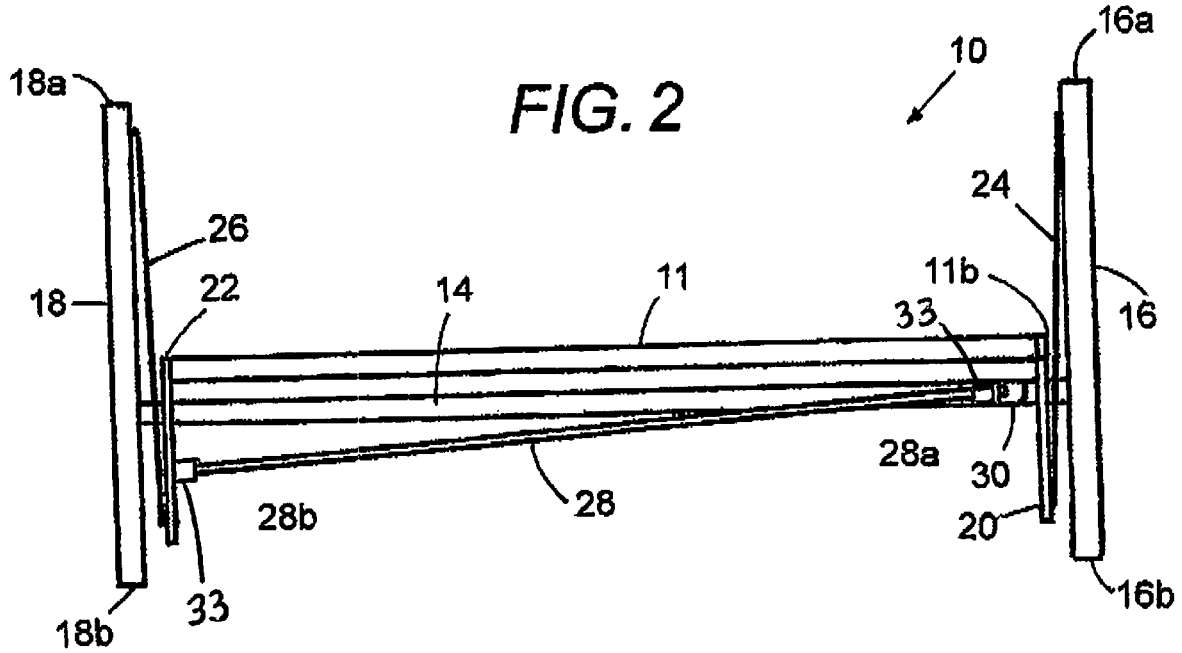
FIG. 2 is a side view showing the swayable bedframe of FIG. 1.
Figure 3:
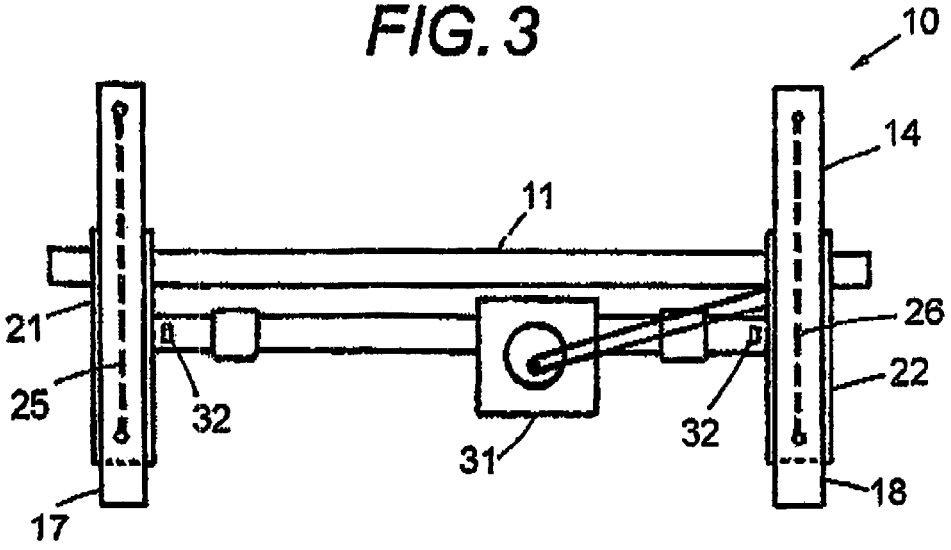
FIG. 3 is an end view showing the swayable bedframe of FIG. 1.

Referring to the drawings, FIG. 1 is a top view, FIG. 2 is a side view, and FIG. 3 is an end view showing an embodiment of a swayable bedframe 10 of the present invention, which generally includes a mattress-supporting rigid platform, a rigid platform support frame, platform support members, suspension cables, longitudinal stabilizers, a drive unit, and sway limiters. The mattress supporting platform of swayable bedframe 10 is shown in the embodiment of FIGS. 1, 2, and 3 as having a mattress-supporting rigid platform 11 having a first end 12, a distal second end 13, and at least four platform corners 11*a*, 11*b*, 11*c*, and 11*d* and a rigid platform support frame 14 having at least four frame legs 15, 16, 17, and 18 joined by corresponding beams with each frame leg including a first end 15*a*, 16*a*, 17*a*, and 18*a* and a second support surface engaging end 15*b*, 16*b*, 17*b*, and 18*b*.

A first platform support member 19 is shown attached proximal to the first platform 11*a* corners, a second platform support member 20 attached proximal to the second platform corner 11*b*, a third platform support member 21 attached proximal to the third platform corner 11*c*, and a fourth platform support member 22 attached proximal to the fourth platform corner 11*d*. It is noted that the platform support members 19, 20, 21, and 22 may each comprise various types of securement members including but not limited to various types of plastic and metal brackets.

The swayable bedframe 10 also includes a first suspension cable 23 connecting the first platform support member 19 to proximal the first end 15*a* of the first frame leg 15, a second suspension cable 24 connecting the second platform support member 20 to proximal the first end 16*a* of the second frame leg 16, a third suspension cable 25 connecting the third platform support member 21 to proximal the first end 17*a* of the third frame leg 17, and a fourth suspension cable 26 connecting the fourth platform support member 22 to proximal the first end 18*a* of the fourth frame leg 18 to allow the rigid platform 11 to sway from side-to-side.

The suspension cables 23, 24, 25, 26 may be made from various types of material having physical properties to provide proper support between platform 11 and frame 14 while minimizing noise resulting from the motion between the rigid frame 14 and platform 11.

Figure 4:
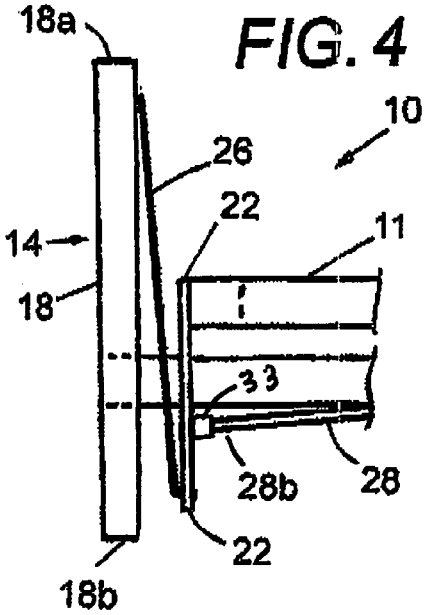
FIG. 4 is a close-up side view showing a second end of the swayable bedframe of FIG. 1.
Figure 5:
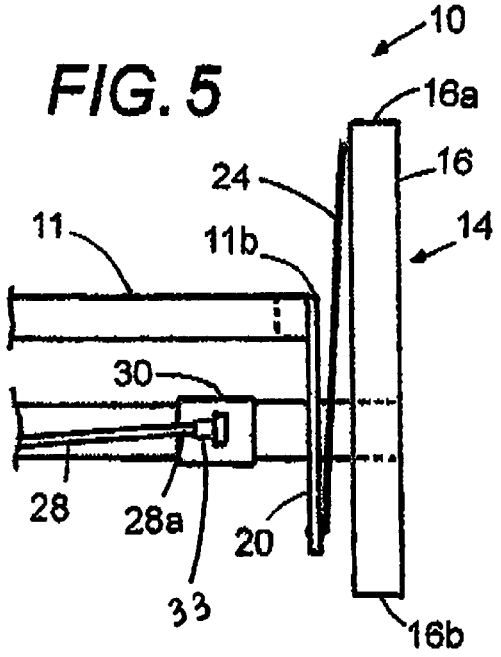
FIG. 5 is a close-up side view showing the first end of the swayable bedframe of FIG. 1.

Referring to FIGS. 4 and 5, FIG. 4 is a close-up side view showing the second end 13 of swayable bedframe 10 and FIG. 5 is a close-up side view showing the first end 12 of swayable bedframe 10. As shown in FIGS. 1, 2, 4, and 5, the swayable bedframe 10 further includes a first longitudinal stabilizer 27 having a first end 27*a* connected to the platform support frame 14 proximal to the first frame leg 15 via a flexible connection 33 with a bracket 29 and a second end 27*b* connected to the third platform support member 21 by flexible connection 33 and a second longitudinal stabilizer 28 having a first end 28*a* connected to the platform support frame 14 proximal to the second frame leg 16 via flexible connection 33 with a bracket 30 and a second end 28*b* connected to the fourth platform support member 22 by flexible connection 33. The flexible connections 33 on the longitudinal stabilizers 27, 28 can be made from an elastomer such as for example a rubber hose-like material or even a leaf spring material. The longitudinal stabilizers 27 and 28 functions to prevent movement of platform 11 in a longitudinal fore and aft direction while allowing side-to-side movement of platform 11 through a flexing connection to enable an angular motion.

Attached to the platform support frame 14 and connected to the rigid platform 11 is a drive unit 31, which functions to provide a reciprocating force such as a sinusoidal motion between the rigid frame 14 and platform 11 resulting in a smooth swaying motion. The drive unit 31 may be controlled manually through switches located on the drive unit 31 or alternatively, controlled remotely by a radio frequency remote control, wi-fi, infrared remote control, or hardwired control. In order to promote relaxation, rest, and sleep, drive unit 31 preferably produces less than 40 decibels of noise when providing the reciprocating force between the rigid frame 14 and the mattress-supporting platform 11. Although the drive unit 31 may comprise different types of systems to provide the reciprocating force such as a sinusoidal motion between the rigid frame 14 and platform 11, FIG. 3 shows the drive unit 31 comprising a motorized belt drive pulley-based system to provide the reciprocating force such as a sinusoidal motion between the rigid frame 14 and platform 11.

The swayable bedframe 10 also includes a set of sway limiters 32 preferably attached to the rigid platform support frame 14 to ensure that the mattress-supporting platform 11 does not exceed a predetermined amount of movement relative to either side of the rigid platform support frame 14 when the drive unit's linkage to the mattress-supporting platform is disconnected.

An alternative embodiment of the present invention may comprise a swayable bedframe in which the suspension cables 23, 24, 25, 26 and the mattress-supporting platform 11 operate in a pendulum-like manner with a resonant frequency as determined by the length of the suspension cables 23, 24, 25, 26. In the aforementioned embodiment, the effort required to sway the mattress-supporting platform 11 from side to side is sufficiently small to allow the drive unit to comprise an electromagnetic system, similar to numerous pendulum drive systems.

I claim:

1. A swayable bedframe that includes:

a mattress-supporting rigid platform having a first end, a distal second end, and at least four platform corners;

a rigid platform support frame having at least four frame legs joined by corresponding beams with each frame leg including a first end and a second support surface engaging end;

a first platform support member attached proximal to the first platform corner, a second platform support member attached proximal to the second platform corner, a third platform support member attached proximal to the third platform corner, and a fourth platform support member attached proximal to the fourth platform corner;

a first suspension cable connecting the first platform support member proximal to the first end of the first frame leg, a second suspension cable connecting the second platform support member proximal to the first end of the second frame leg, a third suspension cable connecting the third platform support member proximal to the first end of the third frame leg, and a fourth suspension cable connecting the fourth platform support member proximal to the first end of the fourth frame leg to allow the rigid platform to sway from side-to-side;

a first longitudinal stabilizer having a first end connected to the platform support frame proximal to the first frame leg and a second end connected to the third platform support member and a second longitudinal stabilizer having a first end connected to the platform support frame proximal to the second frame leg and a second end connected to the fourth platform support member, the longitudinal stabilizers preventing movement of the platform in a longitudinal fore and aft direction;

a flexible connection attaching the first ends of each of the longitudinal stabilizers to the platform support frame and the second ends of the longitudinal stabilizers to their corresponding platform support members is configured to allow side-to-side movement and angular motion of the platform;

a drive unit attached to the platform support frame and connected to the rigid platform, the drive unit providing reciprocating force between the rigid frame and the platform; and a set of sway limiters attached to the rigid platform support frame to ensure that the mattress-supporting platform does not exceed a predetermined amount of movement relative to either side of the rigid platform support frame when the drive unit's linkage to the mattress-supporting platform is disconnected.

2. The swayable bedframe of claim 1 wherein the drive unit provides a sinusoidal motion between the rigid frame and the mattress-supporting platform resulting in a smooth swaying motion.

3. The swayable bedframe of claim 1 wherein the drive unit is controlled by a radio frequency remote control, wi-fi, infrared remote control, or hardwired control.

4. The swayable bedframe of claim 1 wherein the platform support members each comprises a metal bracket.

5. The swayable bedframe of claim 1 wherein the drive unit produces less than 40 decibels of noise when providing the reciprocating force between the rigid frame and the mattress-supporting platform.

6. The swayable bedframe of claim 1 wherein the drive unit comprises a motorized belt drive pulley-based system.

7. A swayable bedframe that includes a mattress-supporting rigid platform having a first end, a distal second end, and at least four platform corners;

a rigid platform support frame having at least four frame legs joined by corresponding beams with each frame leg including a first end and a second support surface engaging end;

a platform support member attached proximal to each of the platform corners, a first suspension cable connecting the first platform support member proximal to the first end of the first frame leg, a second suspension cable connecting the second platform support member proximal to the first end of the second frame leg, a third suspension cable connecting the third platform support member proximal to the first end of the third frame leg, and a fourth suspension cable connecting the fourth platform support member proximal to the first end of the fourth frame leg to allow the rigid platform to sway from side-to-side;

a first longitudinal stabilizer having a first end connected to the platform support frame proximal to the first frame leg and a second end connected to the third platform support member and a second longitudinal stabilizer having a first end connected to the platform support frame proximal to the second frame leg and a second end connected to the fourth platform support member, the longitudinal stabilizers preventing movement of the platform in a longitudinal fore and aft direction;

a flexible connection attaching the first ends of each of the longitudinal stabilizers A to the platform support frame and the second ends of the longitudinal stabilizers to their corresponding platform support members is configured to allow side-to-side movement and angular motion of the platform;

a drive unit attached to the platform support frame and connected to the rigid platform, the drive unit providing reciprocating force between the rigid frame and the platform; and a set of sway limiters attached to the rigid platform support frame to ensure that the mattress-supporting platform does not exceed a predetermined amount of movement relative to either side of the rigid platform support frame when the drive unit's linkage to the mattress-supporting platform is disconnected.

8. The swayable bedframe of claim 7 wherein the drive unit provides a sinusoidal motion between the rigid frame and the mattress-supporting platform resulting in a smooth swaying motion.

9. The swayable bedframe of claim 8 wherein the drive unit produces less than 40 decibels of noise when providing the reciprocating force between the rigid frame and the mattress-supporting platform.

10. The swayable bedframe of claim 9 wherein the drive unit comprises a motorized belt drive pulley-based system.

11. The swayable bedframe of claim 10 wherein the platform support members each comprises a metal bracket.

12. The swayable bedframe of claim 11 wherein the drive unit is controlled by a radio frequency remote control, infrared remote control, or hardwired control.

13. The swayable bedframe of claim 12 wherein the first end of the first longitudinal stabilizer is connected to the platform support frame by a flexible connection between the first longitudinal stabilizer and a first bracket and the first end of the second longitudinal stabilizer is connected to the platform support frame by a flexible connection between the first longitudinal stabilizer and a second bracket.

14. The swayable bedframe of claim 13 wherein the flexible connection comprises a rubber hose-like material.

15. A swayable bedframe that includes a mattress-supporting rigid platform having a first end, a distal second end, and at least four platform corners;

a rigid platform support frame having at least four frame legs joined by corresponding beams with each frame leg including a first end and a second support surface engaging end;

a first platform support member attached proximal to the first platform corner, a second platform support member attached proximal to the second platform corner, a third platform support member attached proximal to the third platform corner, and a fourth platform support member attached proximal to the fourth platform corner;

a first suspension cable connecting the first platform support member proximal to the first end of the first frame leg, a second suspension cable connecting the second platform support member proximal to the first end of the second frame leg, a third suspension cable connecting the third platform support member proximal to the first end of the third frame leg, and a fourth suspension cable connecting the fourth platform support member proximal to the first end of the fourth frame leg to allow the rigid platform to sway from side-to-side;

a first longitudinal stabilizer having a first end connected to the platform support frame proximal to the first frame leg by a first bracket and a second end connected to the third platform support member and a second longitudinal stabilizer having a first end connected to the platform support frame proximal to the second frame leg by a second bracket and a second end connected to the fourth platform support member, the longitudinal stabilizers preventing movement of the platform in a longitudinal fore and aft direction;

a flexible connection attaching the first ends of each of the longitudinal stabilizers to the platform support frame and the second ends of the longitudinal stabilizers to their corresponding platform support members is configured to allow side-to-side movement and angular motion of the platform;

a drive unit attached to the platform support frame and connected to the rigid platform, the drive unit providing a sinusoidal motion between the rigid frame and the mattress-supporting platform resulting in a smooth swaying motion, said drive unit producing less than 40 decibels of noise when providing the reciprocating force between the rigid frame and the mattress-supporting platform, said drive unit having a motorized belt drive pulley-based system; and a set of sway limiters attached to the rigid platform support frame to ensure that the mattress-supporting platform does not exceed a predetermined amount of movement relative to either side of the rigid platform support frame when the drive unit's linkage to the mattress-supporting platform is disconnected.

16. The swayable bedframe of claim 15 wherein the platform support members each comprises a metal bracket.

17. The swayable bedframe of claim 16 wherein the drive unit is controlled by a radio frequency remote control, infrared remote control, or hardwired control.

18. The swayable bedframe of claim 17 wherein the flexible connection comprises a rubber hose-like material or a leaf-type spring.

* * * * *